United States Patent [19]

Minnis

[11] Patent Number: 5,064,382

[45] Date of Patent: Nov. 12, 1991

[54] DETONATOR CONNECTOR SYSTEM

[75] Inventor: Alan J. Minnis, Hendon, England

[73] Assignee: AMP Incorporated, Harrisburg, Pa.

[21] Appl. No.: 578,366

[22] Filed: Sep. 6, 1990

[30] Foreign Application Priority Data

Sep. 8, 1989 [GB] United Kingdom ..... 8920371

[51] Int. Cl.[5] ..... H01R 4/24

[52] U.S. Cl. ..... 439/395

[58] Field of Search ..... 439/389–425

[56] References Cited

U.S. PATENT DOCUMENTS 4,127,312 11/1978 Fleischhacker et al. ..... 339/99 R
4,270,831 6/1981 Takahashi ..... 339/99 R
4,701,139 10/1987 Good et al. ..... 439/497

FOREIGN PATENT DOCUMENTS

WO80/02475 11/1980 PCT Int'l Appl. ..... 13/514
1223430 4/1968 United Kingdom ..... 9/08
1497629 10/1976 United Kingdom ..... 9/08

*Primary Examiner*—Joseph H. McGlynn

[57] ABSTRACT

A connector assembly has a first connector housing and a second connector housing. The first connector housing has terminals which extend from a first end thereof to a second end. The terminals have first cable receiving slots and second cable receiving slots provided at opposed ends thereof. The second connector housing cooperates with a prepared end of a cable, to maintain the cable in alignment with the housing. In use, the first and second connector housings are mated together as the assembly is transported. This insures that the terminals and cable will be protected from the harsh environment into which they are exposed. The configuration of the second cable receiving slots insures that the first and second connectors can be mated and unmated over numerous cycles without damaging the terminals or the cable.

6 Claims, 4 Drawing Sheets

DETONATOR CONNECTOR SYSTEM

FIELD OF THE INVENTION

The invention relates to an electrical connector system which is easy to assemble, and which has the reliability characteristics required. In particular, the connector system is manufactured to be rugged so that the system will perform in the severe environmental conditions in which it will be exposed.

BACKGROUND OF THE INVENTION

Connectors for use with detonators are well known in the industry. These connector typically have insulation displacement type contacts which have grease, or some other type of sealant, provided in surrounding relationship thereto The grease acts to protect the contacts from the harsh conditions into which the connector is generally positioned. Although these connectors have preformed adequately in the past, several problems are associated with these connectors In many instances, the use of these connectors is required in areas in which space and light are scarce, i.e. in a mine shaft Therefore, the ease of installation is an important feature associated with these types of connectors. However, the connectors currently available are not particularly easy to install.

With the prior art connectors relates to the insulation displacement portions of the terminals. In order to provide a sufficient force to insure that all of the electrical connections have been made between the contacts and the cable of the detonator, a handle tool, or the like, must be used. This is due to the fact that the worker can not exert enough force on the connector the insure that a positive electrical connection has been affected. Consequently, in the prior art a hand tool was required to insure that a proper electrical connection has been made. This is unacceptable, as the use of hand tools is not possible under all circumstances.

Another problem associated with the prior art connectors relates to the number of pieces required. As the connectors are to be operated in severe conditions, it is essential that the contacts be protected at all times. Consequently, the connectors currently available have covers associated therewith, in order to insure that the terminals are not damaged. The use of the covers protects the contacts, however, the covers are loose pieces which are not desirable when the connectors are to be installed and operated.

Therefore, it would prove beneficial to provide electrical connectors for use with detonators which do not require the use of covers or other loose pieces, and which do not require the use of tooling for the assembly of the connectors to the detonators.

SUMMARY OF THE INVENTION

The invention is directed to a connector assembly which is relatively easy and inexpensive to manufacture. The configuration of the assembly eliminates the need for covers and other loose pieces, while still providing the protection required to insure that the assembly will perform in the harsh environments into which it will be placed. The entire assembly can be mated without the need for tooling.

The electrical connector assembly has a first connector housing which has a first major surface and a second major surface. Terminals are positioned in the housing and extend from the first major surface to the second major surface. Wire receiving slots are provided at the first ends of the terminals, and first cable receiving means are provided adjacent second ends of the terminals. The first cable receiving means cooperate with cable means to provide an electrical connection between the cable means and the terminals of the first connector housing.

A second connector housing, which is also part of the electrical connector assembly, has a first surface and a second surface. A connector receiving opening extends from the first surface toward the second surface, the connector receiving opening is dimensioned to receive the first connector housing therein. Second cable receiving means are provided on the second connector housing, adjacent the connector receiving opening. The second cable receiving means cooperates with an end of the cable means to position the cable means in alignment with the opening. By this arrangement, the first connector housing and the second connector housing may be mated together as required, thereby insuring that the terminals and the cable are protected from the environment.

BRIEF DESCRIPTION OF THE DRAWINGS

FIG. 6 is a diagrammatic view of the assembly as the assembly is transported.

DETAILED DESCRIPTION OF THE INVENTION

Figure 1:
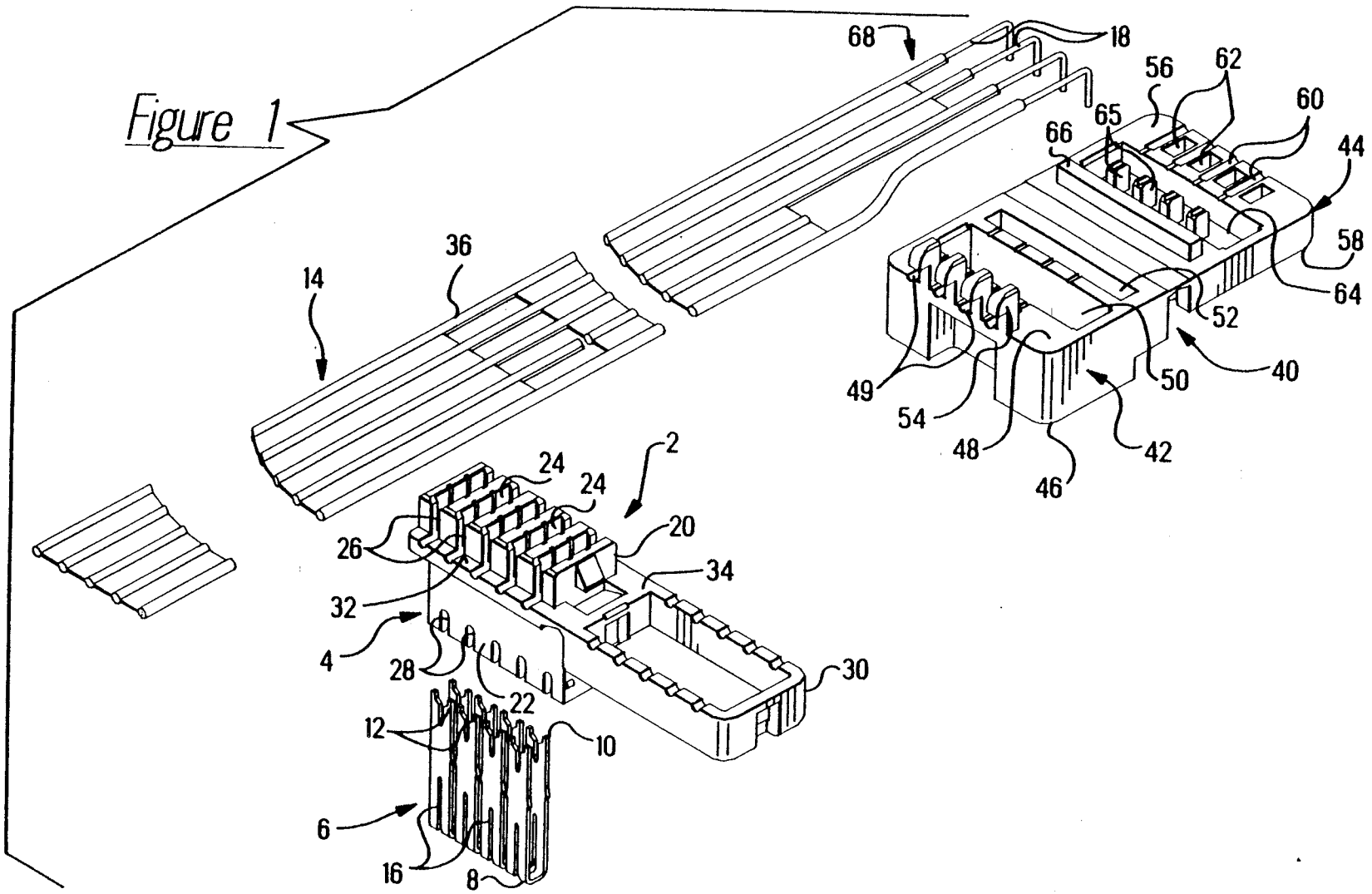
FIG. 1 is a perspective view of a connector assembly according to the present invention, a through line connector and an end line connector are exploded and rotated from the cable in order to better illustrate internal features of the components.

As shown in FIG. 1, a through line electrical connector 2 has a dielectric housing 4 with terminals 6 provided therein. The terminals are spaced from and separated from each other by the dielectric housing.

Figure 5:
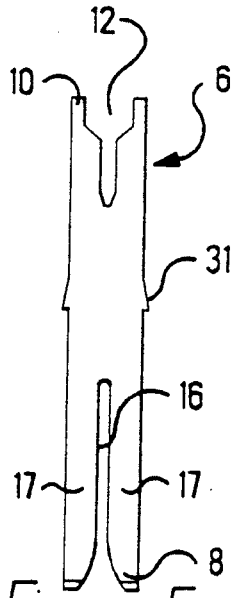
FIG. 5 is a side view of a terminal which is provided in the through line connector.

Referring to FIGS. 1 and 5, each terminal 6 has a generally U-shaped configuration, with a first end 8 and a second end 10. It should be noted that the terminals can be made from any electrically conductive material having the electrical characteristics required. However, in harsh environments, i.e. gold mining, the contact is typically made from steel in order to avoid any copper alloy contamination in the gold separation process.

Figure 3:
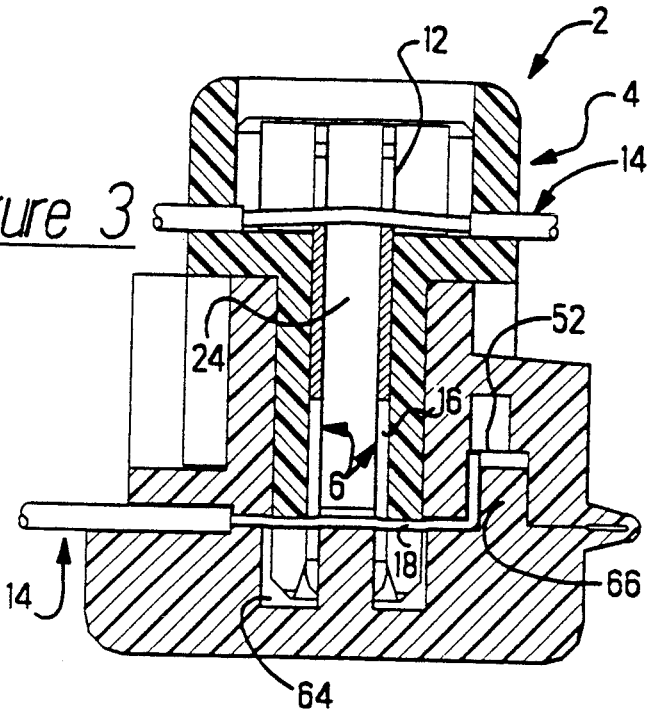
FIG. 3 is a cross sectional view showing a respective through line connector mated with a respective end line connector.
Figure 4:
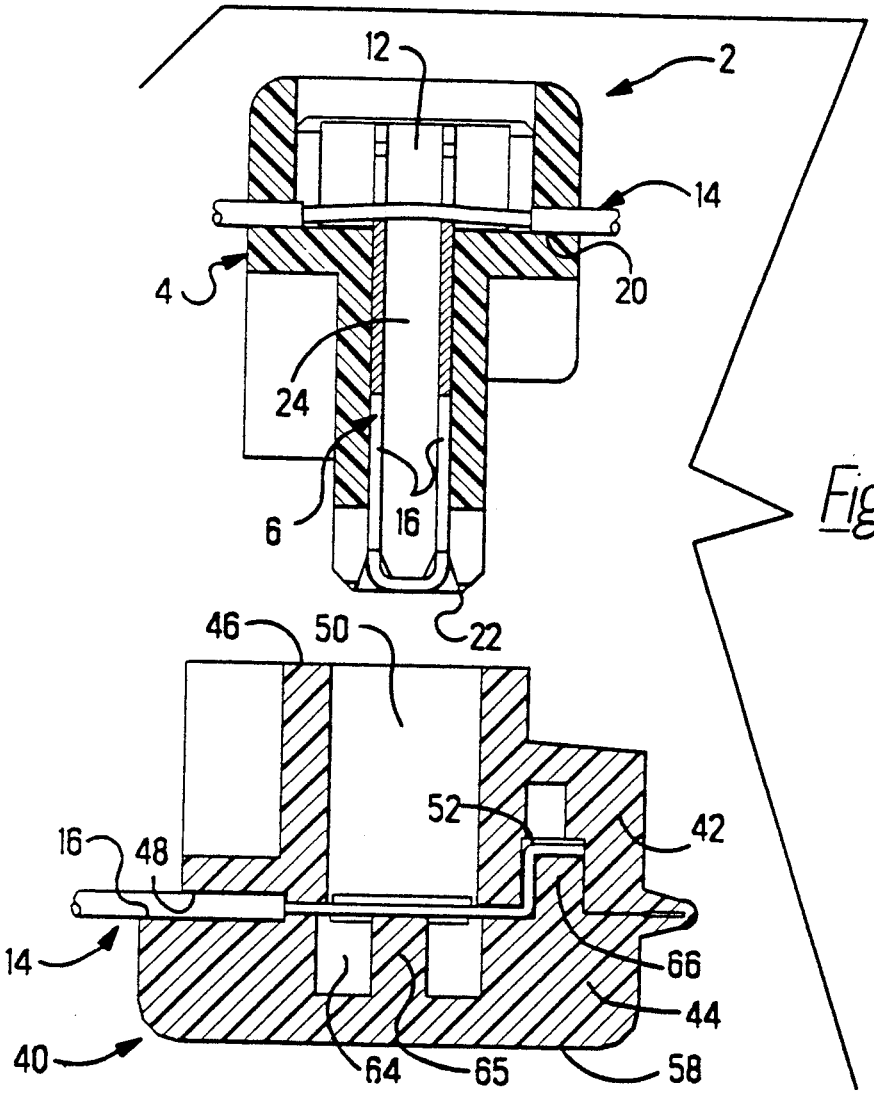
FIG. 4 is a cross sectional view, similar to FIG. 3, showing the through line connector and the end line connector prior to being mated together.

Insulation displacement slots 12 extend from the second ends 10 of the terminals 6 toward the first ends 8. As is shown in FIGS. 1, 3 and 4, each terminal 6 has two insulation displacement slots 12 positioned in alignment with each other. Consequently, as a respective wire of the cable 14 is moved into cooperation with the appropriate terminal 6, the wire cooperates with both slots 12 of the terminal 6, as shown in FIGS. 3 and 4. This provided the redundancy required to insure that a positive electrical connection is made between the cable and the connector. It is worth noting that the ribbon cable may be manufactured from steel wire, thereby avoiding any copper alloy contamination in the gold separation process.

Slots 16 (FIG. 1) extend from the first ends 8 of the terminals 6 toward the second ends 10. As the slots 16 mate with bare wires 18 (wires in which the insulation has been stripped), the slots 16 are not of the insulation displacement type. Each first or mating end 8 of the terminals has two slots provided thereon, the slots cooperate to provide the redundancy required to insure that a proper electrical connection is affected.

The mating ends 8 of the terminals are configured as spring beams. Portions 17, provided adjacent slots 16 have resilient characteristics, which allow the portions 17 to deform as the wires are inserted into the slots. However, the slots 16 are dimensioned such that as the wires 18 are inserted therein, only a minimal amount of deflection of portions 17 will occur. This minimal deflection is within the elastic deformation range of the material and consequently the wires and the terminals can be mated and unmated repeatedly without damage to either the sire or the terminal. It is important to note that the slots 16 are configured to provide the correct contact normal force between the wires 18 and the terminals 6, such that the contact normal force will be sufficient to insure that a positive electrical connection is effected, with a low millivolt drop associated therewith.

Referring back to FIGS. 1, 3 and 4, dielectric through line housing 4 has a cable receiving end 20 and a mating end 22. Terminal receiving cavities 24, which are essentially parallel to and spaced from each other, extend from the cable receiving end 20 to the mating end 22. Slots 26, 28 are provided proximate the cable receiving end 20 and the mating end 22 respectively. The slots 26, 28 cooperate with terminal receiving cavities to provide a wire receiving area which extends through the housing 4.

The housing 4 has a strain relief cover 30 which is hinged thereon. As the cover is hinged to the housing, the connector 2 can be made in a single molding. This simplifies the manufacturing process, as well as minimizes the number of individual pieces which have to be assembled.

Figure 2:
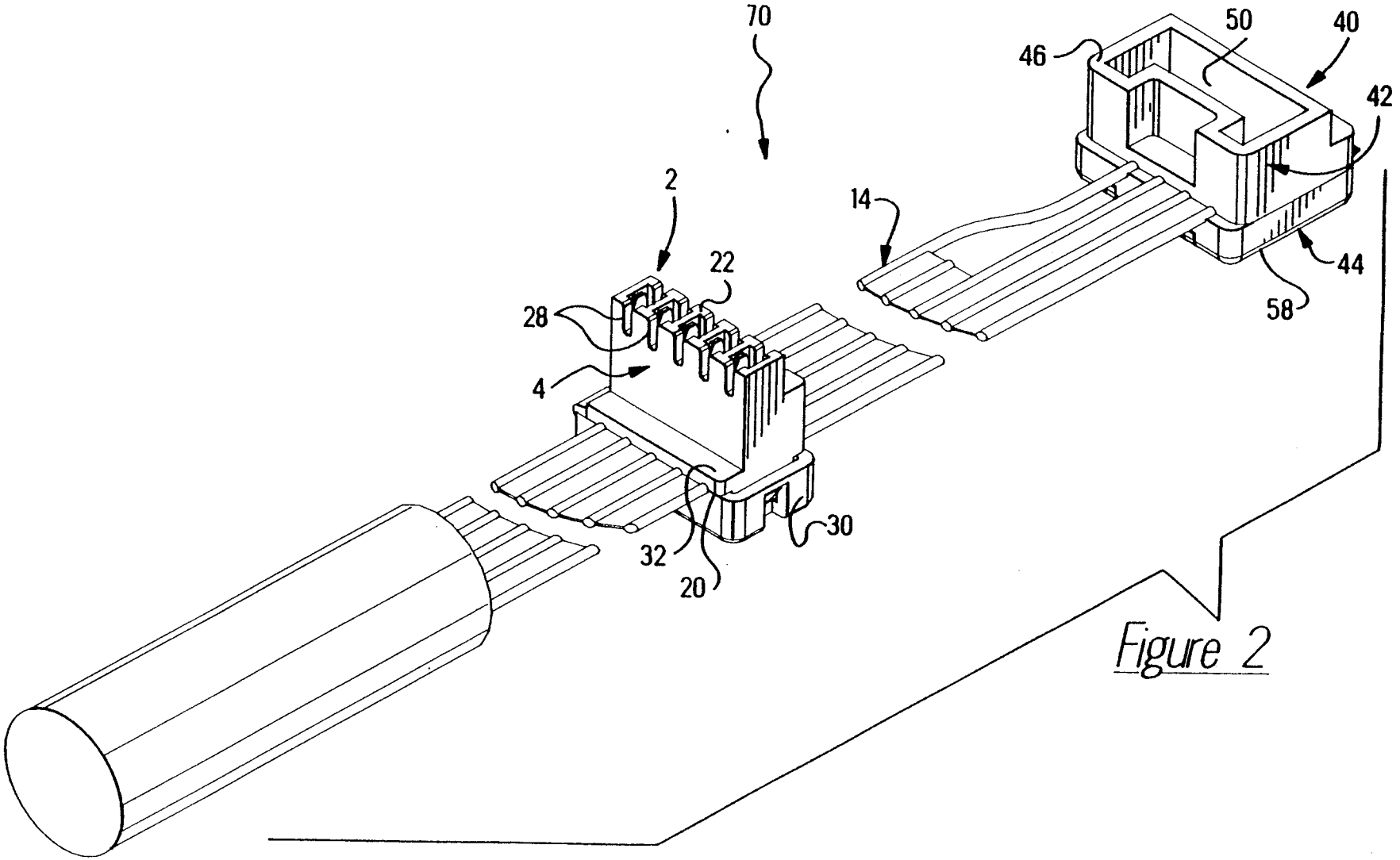
FIG. 2 is a perspective view of the assembly, similar to that of FIG. 1, with all of the components assembled on the cable.

As best shown in FIGS. 1 and 2, the housing 4 has a shoulder 32 provided proximate to the cable receiving end 20. The shoulder 32 extends along at least one side wall of the housing 4 of connector 2. The cover 30 is integrally attached to the housing 4 by means of the hinge 34, which is positioned adjacent to the shoulder. The configuration of the hinge allows the latch to move between an open position, as illustrated in FIG. 1, and a closed position, as shown in FIG. 2.

With the cover 30 provided in the open position, the terminals 6 are loaded or stitched into respective terminal receiving cavities 24 and maintained in position by the cooperation of the barbs 31 (FIG. 5) of the terminals with the side walls of the cavities 24. The terminals are positioned such that the ends 8, 10 of the terminals 6 are flush with the respective ends 20, 22 of the connector housing 4. This positioning of the terminals insures that as the terminals are subjected to high load insertion, the load will be transferred through the terminals to the support tooling, rather than to the molded housing.

After the terminals 6 have been loaded into the housing 4, the cable 14 is moved into position with respect to the housing As shown in FIG. 1, the cable has notched portions 36 which have exposed parallel wires. The notched portions 36 of the cables 14 are moved into engagement with the connector, thereby causing the individual wires of the cable to move into the respective slots 12 of the terminals and slots 26 of the housing. During this operation, the insulation of the cable is pierced according to the known method of insulation displacement technology, thereby placing the wires of the cable in electrical engagement with the terminals of the connector. As shown in FIGS. 3 and 4, the cable is fully inserted into the slots of the terminals when the cable is provided in engagement with the shoulder 32 of the housing.

With the cable 14 fully inserted into the slots 12 of the terminals, the cover 30 is moved from the open position to the closed position. In this closed position the cover is latched or maintained in position relative to the cable and the housing, thereby providing the strain relief required to insure that the electrical connection effected between the wires and the terminals will be maintained over time. With the strain relief latched in position, a seal is provided between the cable and the housing.

Grease, or some other protective substance, is packed into the terminal receiving cavities, after the cover has been closed. The grease packing protects the terminals and electrical connections from the harsh environments in which the connector will be exposed, more specifically the use of the grease prevents the ingress of debris and moisture. It is important to note that the grease is positioned in the cavities 24 from the mating end 22.

As shown in FIGS. 1 through 4, an end line connector 40 has a dielectric housing 42 with a cover 44 hingedly attached thereto. As best shown in FIG. 1, the housing 42 has a mating face 46 and a cable receiving face 48. The cable receiving face has channels 49 provided therein for receiving the bare wires of the cable 14. A connector receiving opening 50 is provided in housing 42 and extends from the mating face 46 to the cable receiving face 48. A wire retention opening 52 is positioned proximate the connector receiving opening 50. The opening 52 extends from the cable receiving face 48 toward the mating face 46. Latch projections 54 are provided adjacent channels 49 and extend from the cable receiving face 48 in a direction away from the mating face 46.

Cover 44 is hinged to housing 42, such that the cover is movable between an open position, as shown in FIG. 1, and a closed position, as shown in FIG. 2. The cover has a first surface 56 and an oppositely facing second surface 58. The first surface has channels 60 positioned thereon, the channels being provided in alignment with the channels 49 of the housing 42. Positioned between the channels 60 are latch receiving openings 62. The latch receiving openings 62 cooperate with the latch projections 54 to maintain the cover 44 in a closed position.

As best shown in FIGS. 1 and 4, a recess 64 extends from the first surfaces 56 of the cover toward the second surface 58. Recess 64 aligns with opening 50 when the cover 44 is provided in the closed position. Wire supports 65 are provided in recess 64, and extend from the bottom surface of the recess to the first surface 56.

A securing bar 66 is positioned proximate recess 64. The securing bar 66 is integrally attached to the first surface 56 and extends in a direction away from second surface 58. The dimensions of securing bar 66 are essentially the same, but slightly smaller than the dimensions of opening 52, thereby insuring that the securing bar 66 and opening 52 will cooperate with the bared wires to maintain the wires in position, as will be more fully discussed.

Connector 40 is configured to cooperate with a dressed end 68 of the cable 14. As shown in Figure, the end 68 of the cable is stripped of insulation to expose the bare wires 18. The bared wires are then bent so that the ends thereof extend at approximately a ninety degree angle from the longitudinal axis of the cable.

The dressed end 68 of the cable is moved into position relative to connector 40. With the cover 44 in the open position, the individual wires are laid in the channels 49 and the bent ends of the bared wires are placed in the wire retention opening 52. This positioning of the wires insures that the wires are aligned in the connector receiving opening 50. It should be noted that the spacing between the latch projections 54 is dimensioned to guide the wires into the channels.

With the wires positioned in the channels 49, the cover 44 is moved from the open position to the closed position. As this movement occurs, securing bar 66 engages the bent ends of the wires, thereby trapping the wires between the walls of the opening 52 and the surfaces of the securing bar 66. Consequently, as the wires are trapped or maintained in position, the further closing of the cover 44 allows the channels 60 and supports 65 to cooperate with the wires. When fully closed, the latch projections 54 engage surfaces of the latch receiving openings 62 to maintain the cover 44 in the closed position.

Cover 44 provides the means to insure that the wires are maintained in alignment. The cover also provides the axial strain relief required. Consequently, connector 40 is provided to locate and clamp the wires for mating.

With connectors 2, 40 properly inserted onto cable 14, as shown in FIG. 2, the assembly 70 is transported to the field. As was previously stated, the environments into which these assemblies are to be used can be harsh (i.e. mines, etc.). Consequently, it is essential that the connectors be protected during shipping and storage. Therefore, connector 40 is mated with connector 2, as shown in FIG. 6.

To mate connectors 2, 40, the cable 14 is bent, as shown in FIG. 6. Connector 40 is then moved onto connector 2, such that the mating end 22 of the connector 2 is positioned in the connector receiving opening 50 of connector 40. This movement is continued until shoulder 32 engages the mating face 46, thereby preventing further motion. In this fully inserted position, the bared wires 48 are inserted into the slots 16 and are provided in electrical engagement therewith. The supports 65 cooperate with the wires 18 to insure that the wires are positioned in slots 16 when the connector 40 is inserted onto connector 2.

By mating the connectors together, the grease prevents the ingress of debris and moisture into either connector. As was previously stated, the configuration of slots 16 allow for the connectors to be mated and unmated numerous times without damaging either connector.

Figure 7:
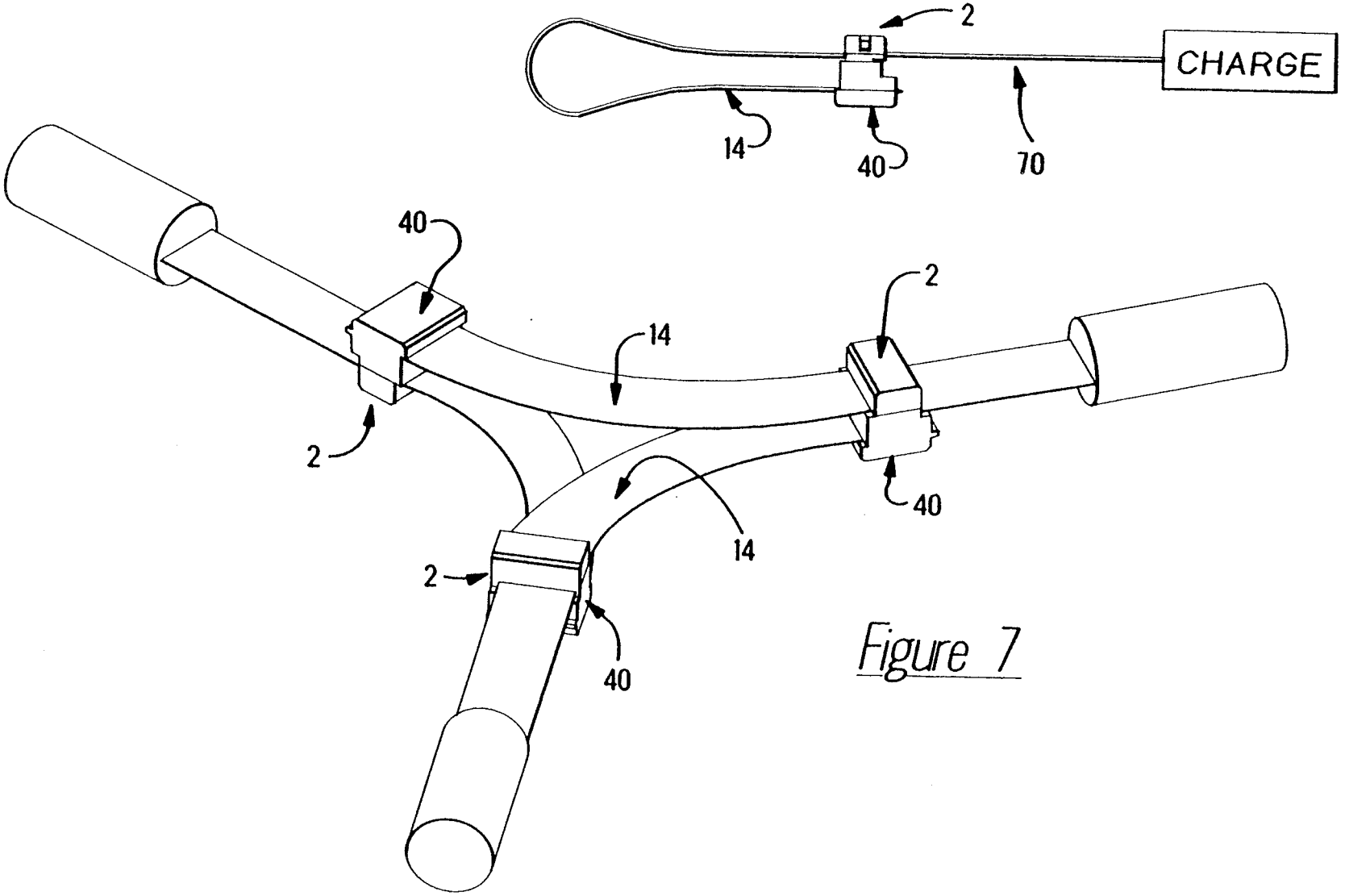
FIG. 7 is a diagrammatic view of several assemblies which are interconnected together.

When the detonator assemblies 70 have been properly positioned, the operator separates the two housings and mates the respective housings to corresponding housings of other respective assemblies, as illustrated in FIG. 7. This provides the means to allow for simultaneous explosion of many detonator assemblies.

The use of the assemblies of the present invention has many advantage over connector assemblies currently used. The present invention has connectors which are manufactured from one piece and are relatively inexpensive to produce. However, the reliability and ruggedness of this assembly is not lessened.

Perhaps one of the most significant advantages of the present invention relates to the ease of operation. In prior connectors, many pieces were required to insure that debris and moisture did not enter the connector (i.e. covers, etc.). However, in the present invention, the connectors 2, 40 are mated together to prevent the ingress of debris and moisture. This eliminates the need for covers and avoids any loose components being required in the mine shaft or other environment. Consequently, the ease of installation is enhanced.

The ability to pack the grease in the connector from the mating surface is also of benefit. This allows the connector 2 to be fully assembled before the grease is positioned in the cavities.

It is also worth noting that the mating and unmating of the connectors does not require the use of tooling This is due to the fact that the slots 16 are not insulation displacement type slots, and therefore, a large force is not required when mating occurs. Consequently, the operator can use his hands to mate and unmate the connectors.

Changes in construction will occur to those skilled in the art and various apparently different modifications and embodiments may be made without departing from the scope of the invention. The matter set forth in the foregoing description and accompanying drawings is offered by way of illustration only.

What is claimed is:

1. An environmentally sealed electrical connector assembly for operation in hostile environments, while capable of being readily assembled into complex interconnection systems of like connector assemblies, said assembly comprising:

a first connector housing having a first major surface and a second major surface, terminals positioned in the housing and extending from the first major surface to the second major surface, wherein the first connector housing is provided with a protective substance which surrounds the terminals, thereby insuring that the terminals will not be damaged under hostile types of environmental conditions, wire receiving slots provided at first ends of the terminals, first cable receiving means provided adjacent second ends of the terminals, the first cable receiving means cooperating with multiconductor cable means to provide electrical connection between said cable means and said terminals of the first connector housing;

a second connector housing having a first surface and a second surface, a connector receiving opening extending from the first surface toward the second surface, the connector receiving opening being dimensioned to receive the first connector housing therein, second cable receiving means provided adjacent the connector receiving opening, the second cable receiving means cooperating with a remote end of said cable means to position the cable means in alignment with said opening;

whereby the first connector housing and the second connector housing can be looped about said cable means and mated together as required for purposes of storage or transportation, then unmated for subsequent mating with like connector assemblies while being protected against the hostile conditions of the environment.

2. An electrical connector assembly as claimed in claim 1 wherein the first cable receiving means are insulation displacement slots which cooperate with the cable means to penetrate said insulation and place the cable means in electrical connection with the terminals.

3. An electrical connector assembly as claimed in claim 1 wherein the second cable receiving means are channels which extend through the second connector housing, the channels extend in a direction which is essentially parallel to the first surface of the housing.

4. An electrical connector assembly as claimed in claim 1 wherein the cable means is a flat cable which has individual conductors spaced apart by a dielectric material.

5. An electrical connector assembly as claimed in claim 1 wherein the end of the cable means which cooperates with the second connector housing has bared wires which have had the insulation stripped therefrom, the bared wires being bent so that the end of the cable will be maintained in position relative to the second connector housing.

6. An electrical connector assembly as claimed in claim 5 wherein the wire receiving slots of the terminals have spring beams provided adjacent thereto, such that as the bared wires are inserted into the slots, the spring beams will deflect within their elastic range, providing the terminals with the normal force required to insure that a positive electrical connection is effected between the bared wires and the terminals.

* * * * *